US005114491A

United States Patent [19]

Sarhaddar

[11] Patent Number: 5,114,491

[45] Date of Patent: May 19, 1992

[54] METHOD FOR HYDROLYZING STARCH TO PRODUCE SACCHARIFIED MASH

[75] Inventor: Schahroch Sarhaddar, Vienna, Austria

[73] Assignee: Vogelbusch GmbH, Vienna, Austria

[21] Appl. No.: 741,987

[22] Filed: Aug. 7, 1991

Related U.S. Application Data

[63] Continuation of Ser. No. 636,016, Jan. 4, 1991, abandoned, which is a continuation of Ser. No. 14,124, Feb. 2, 1987, abandoned, which is a continuation of Ser. No. 616,482, Jun. 1, 1984, abandoned.

[30] Foreign Application Priority Data

Jun. 9, 1983 [AT] Austria ..... 2108/83

[51] Int. Cl.[5] ..... C13K 1/06

[52] U.S. Cl. ..... 127/38; 127/36; 435/96

[58] Field of Search ..... 127/36, 38, 32, 33; 435/93, 96, 99

[56] References Cited

U.S. PATENT DOCUMENTS

| | | | |
|---|---|---|---|
| 3,185,633 | 5/1965 | Krebs | 127/38 X |
| 3,607,395 | 9/1971 | Stephenson | 127/38 |
| 4,287,304 | 9/1981 | Muller | 127/38 |
| 4,414,330 | 11/1983 | Zucker et al. | 127/38 |
| 4,699,670 | 10/1987 | Morehouse et al. | 127/38 |

FOREIGN PATENT DOCUMENTS

| | | |
|---|---|---|
| 101450 | 10/1925 | Austria . |
| 068043 | 1/1983 | European Pat. Off. . |
| 1101310 | 1/1968 | Fed. Rep. of Germany . |
| 1938394 | 2/1970 | Fed. Rep. of Germany . |
| 2018031 | 10/1970 | Fed. Rep. of Germany . |
| 945514 | 1/1964 | United Kingdom . |
| 1243530 | 8/1971 | United Kingdom . |

OTHER PUBLICATIONS

Product literature of Novo Industrias (Denmark) relating to "Novo Enzymes" (Sep. 1980).

H. Rompp, Chemie Lexikon, p. 4818 (1962).

*Primary Examiner*—W. Gary Jones

*Attorney, Agent, or Firm*—Henry M. Feiereisen

[57] ABSTRACT

There is described a method for the hydrolysis of starch to produce saccharified mash by hydrolyzing and solubilizing amylaceous raw materials above the gelatinization temperature of the starch at atmospheric pressure. The resulting mixtures are saccharified upon cooling by the addition of a saccharifying enzyme. In order to avoid a pre-treatment and purification of the comminuted raw materials as well as long heating and retention periods, thus having a low energy demand despite a complete hydrolysis of starch, comminuted and otherwise untreated grains are stirred into an aqueous take-up liquor being in a hydrolyzing vessel and maintained at a temperature of from 85° to 100° C. Acid is added prior to stirring in or a solubilizing enzyme is added during stirring in. The hydrolyzed mixture obtained is cooled to 60° to 65° C. without retention time in the hydrolyzing vessel and is conducted to the saccharification step.

7 Claims, 1 Drawing Sheet

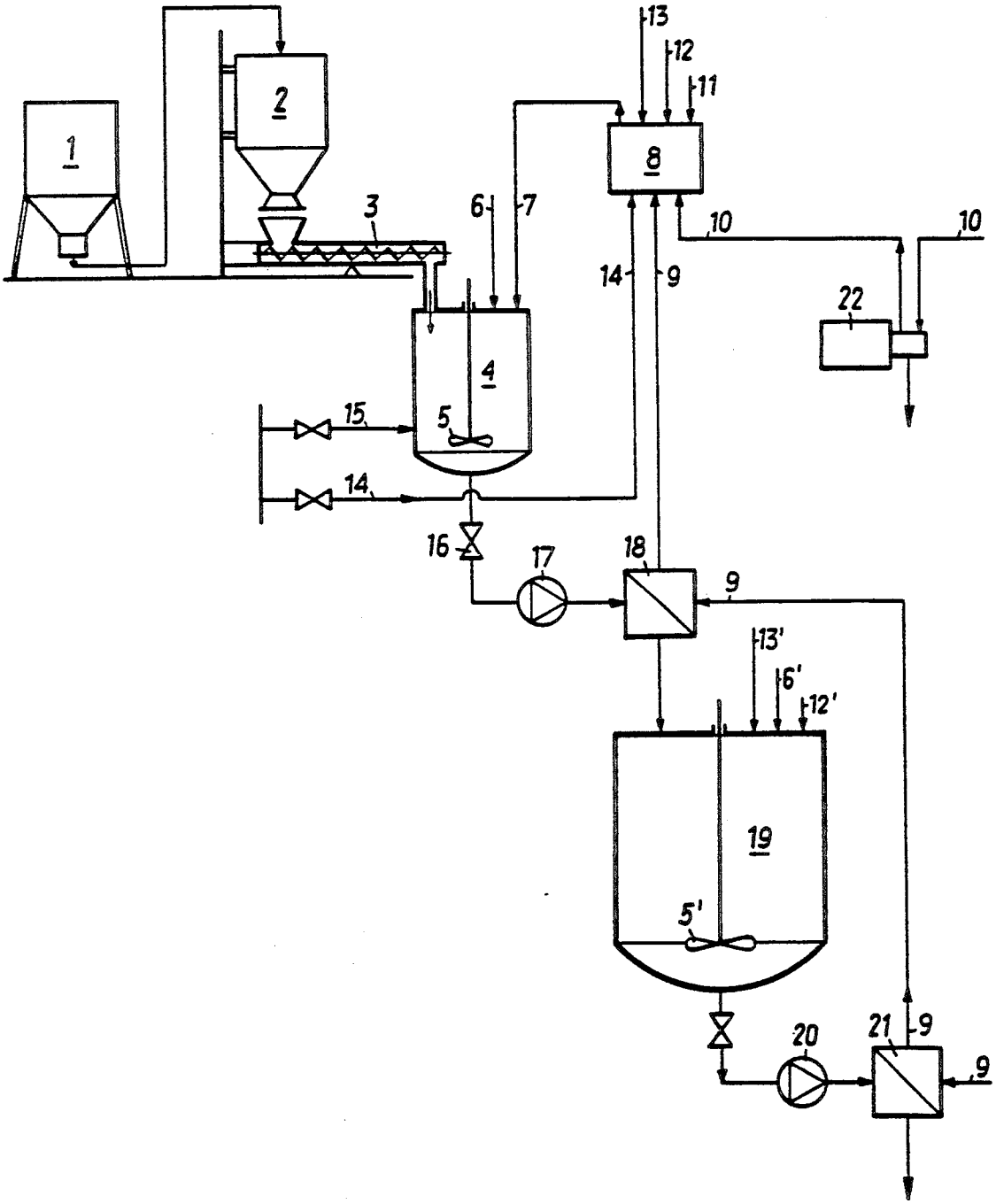
1
2
3
4
5
6
7
8
9
10
11
12
13
14
15
16
17
18
19
20
21
22
5'
6'
12'
13'

METHOD FOR HYDROLYZING STARCH TO PRODUCE SACCHARIFIED MASH

This application is a continuation of application Ser. No. 07/636,016, filed on Jan. 4, 1991, now abandoned, which is a continuation of application Ser. No. 07/014124, filed on Feb. 2, 1987, now abandoned, which is a continuation of application Ser. No. 06/616,482, filed on June 1, 1984, now abandoned.

The invention relates to a method for the hydrolysis of starch to produce saccharified mash by hydrolyzing and solubilizing amylaceous raw materials above the gelatinization temperature of the starch at atmospheric pressure and saccharifying the resulting mixtures upon cooling by the addition of a saccharifying enzyme.

At present, various methods of hydrolyzing starch are being used. However, they often involve disadvantages, in particular either the starch is not completely hydrolyzed or a large amount of energy is required.

It is common to all of these methods that, during operation, retention times must be observed for mashing, hydrolysis and solubilization.

In German Offenlegungsschrift No. 20 18 031 a two-step method is described, in which starch is gelatinized at temperatures of between 85° and 170° C. in the first step (A). Up to 100° C., this step can be carried out in the presence of α-amylase. As starting products, so-called "glutinous starches", i.e. starches having a high content of amylopectin, are used in the first place with the known method. If so-called "overground" starches, such as corn starch, are used, larger amounts of enzymes must be used, and after solubilization heating to 130° C. is required.

However, according to German Offenlegungsschrift No. 20 18 031, it is necessary for all of the embodiments to use, as starting products, suspensions of thoroughly purified starches, which are gradually heated. The gelatinization itself preferably is carried out in the presence of α-amylase under pressure, retention times of 20 min and more being provided. The necessary purification of the starches prior to hydrolysis is connected with losses and an elevated energy consumption. Also the application of pressure and the observance of heating and retention times affect the economy of the method. In the second step (B), according to German Offenlegungsschrift No. 20 18 031, the selective cleavage of the bindings of the branched parts of the amylopectin molecules with α-1,6-glucosidases takes place.

The present invention has as its object to provide a method for hydrolyzing amylaceous grains, with which method operation is possible without pre-treatment of the comminuted raw materials as well as without observance of the above-mentioned retention times and, accordingly, with a considerably lower energy consumption, wherein a complete hydrolysis of starch is achieved, nevertheless.

This object is achieved, with a method of the initially-defined kind, in that as amylaceous raw materials comminuted and otherwise untreated grains, such as comminuted corn, are used, these comminuted grains are stirred into an aqueous take-up liquor being in a hydrolyzing vessel and maintained at a temperature of from 85° to 100° C., preferably 90° to 95° C., with acid being added prior to stirring in or with a solubilizing enzyme, in particular amylase, being added during stirring in, and the hydrolyzed mixture obtained is cooled to 60° to 65° C. without retention time in the hydrolyzing vessel and is conducted to the saccharification step.

The surprising effect, namely the complete saving of the retention times usually necessary for hydrolysis and solubilization, presumably is achieved in that, on account of the high mashing temperature (between 90° and 95° C.) immediately attained, a substantially more intensive and rapid gelatinization of the starch grains, i.e. disintegration of the grain structure, takes place and, therefore, the added thermostable α-amylase or added acid are able to solubilize the starch substantially more quickly.

Up to recently, the hydrolysis of starch has been realized almost exclusively according to various high-pressure steaming methods, with temperatures of between 150 and 160° C. and pressures of from 5 to 6 bar being applied.

In addition to the poor economy of this method resulting from permanently increasing energy costs, also caramel substances and melanoidins will form by the Maillard reaction, thus reducing the yield.

With the pressure hydrolysis of starch in the known Henze steamer, about 250 to 300 kg steam/hl alcohol are required, which is obtained by the fermentation of the hydrolyzed saccharified starch. According to the likewisely common continuous high-pressure method, a steam consumption of about 150 to 200 kg is to be expected per hl of alcohol.

The so-called cold mashing process, which has been known for long and is carried out without pressure at temperatures of below 65° C., is particularly suited for types of cereals that have a natural content of amylase, such as wheat and rye. However, it is hardly applied today, in particular because of the risk of infections caused by the low temperature. Moreover, the degree of hydrolysis of the starch thereby achieved mostly is unsatisfactory.

By the method according to the invention, side reactions which, among others, lead to the above-mentioned caramelization are avoided, which has positive effects on the yield, in particular with a subsequent fermentation of the sugars to alcohol. The apparatus expenditures necessary for carrying out the method are very low, usually it can be operated with existing plants slightly modified.

Thermostable α-amylases, which may suitably be used for the method according to the invention, are easily accessible, present in large amounts and commercially available at any time.

Preferably, when using acid as hydrolyzing agent, the pH is adjusted to 1.5 to 3.5, preferably 1.5 to 2.5, and, when using solubilizing enzyme as hydrolyzing agent, the pH is adjusted to a value of from 4.0 to 8.0, preferably 6.0 to 7.0.

The addition of the comminuted grains, in case of discontinuous or semi-continuous process operation, is effected within 5 to 20 min, preferably within 10 to 15 min.

According to an advantageous embodiment of the method according to the invention, distiller's wash from the distillative processing of the saccharified mash subjected to an alcoholic fermentation—if desired, after separation of solids, is used as take-up liquor at least for part, without cooling. Since the resulting distiller's wash has a high temperature, anyway, one can do without the major part of the thermal supply otherwise necessary to heat the take-up liquor.

According to a further preferred embodiment, the hydrolyzing and saccharifying steps are carried out continuously.

The invention will now be explained in more detail by way of the accompanying drawing, which is an illustration of a plant scheme, and by the following examples.

The grains are comminuted in a mill 1 and intermittently stored for a short time in a storage container 2. From this container 2, the comminuted grains, via a dosing worm 3, reach the hydrolyzing vessel 4, which is equipped with a stirring organ 5 as well as with a supply 6 for enzyme solution, and which is connected with a mixing vessel 8 via a duct 7. In the mixing vessel 8, water from supply 9 or recycled distiller's wash from duct 10 are treated and adjusted to the desired pH by the addition of $Ca^{2\oplus}$ions from duct 11, of lye from duct 12 or of acid from duct 13. The aqueous take-up liquor thus obtained, if necessary, is brought to the desired process temperature by introducing fresh steam from duct 14, and is drawn into the hydrolyzing vessel 4 via duct 7. A further steam supply 15 for keeping constant the temperature during the hydrolyzing process, leads to the hydrolyzing vessel 4. Upon opening of a closing organ 16, the hydrolyzed mixture is pumped from the outlet in the conically designed bottom of the vessel 4 into a saccharification tank 19 by means of a pump 17 via a first heat exchanger 18. In the heat exchanger 18, water destined for the take-up liquor can be pre-heated and introduced into the mixing vessel 8 via supply 9. Supplies for enzyme 6', for acid 12' and for lye 13' enter into the saccharification tank in case of acidic hydrolysis. In the tank, a stirring organ 5' is, furthermore, provided. From the tank 19, saccharified mash is conveyed to a fermenting station (not illustrated) by means of a second pump 20, via a second heat exchanger 21, after having adjusted the desired mash concentration with water or with distillers' wash. In the distiller's wash duct 10, a deposition means 22 (e.g., a decanter) is installed for the solid residues possibly contained in the distiller's wash. The aqueous supernatant, after decantation, gets into the mixing vessel 8.

EXAMPLE 1

2,500 to 3,000 l water or decanted distiller's wash having a temperature of between 90° and 95° C. are provided. This aqueous take-up liquor previously has been adjusted to a pH of between 6 and 7 in the mixing vessel 8 by the addition of base ($OH^{\ominus}$ions) and is admixed with $Ca^{2\oplus}$ions up to a content of 50 to 70 ppm. 1 t of ground corn is stirred in within approximately 10 min, the hydrolyzing mixture being maintained between the indicated temperature limits by injecting fresh steam from duct 15. After having stirred in about 20 to 30% of the total amount of ground corn, thermostable α-amylase is added. Immediately after having completed the addition of corn, the hydrolyzed mixture is conveyed into the saccharification tank 19 upon streaming through the first heat exchanger 18, whereby the mixture cools to about 60° C. The pH of the mixture now being in the saccharification tank is adjusted to 4.5 to 5.0 by acid addition, and subsequently amyloglucosidase is added. After a retention time of at least 30 min, the partially saccharified mash is conveyed to the fermenting station upon cooling to about 30° C. in the second heat exchanger 21. After having adjusted the desired mash concentration by water or distiller's wash, the saccharified mash is then admixed with yeast mash in the fermenting tun. The cooling water, which has been pre-heated from an initial temperature of about 15° C. to about 80° C. in the heat exchangers 18 and 21, either is directly supplied to the mixing vessel 8 to produce the take-up liquor or—if mainly decanted dilute distiller's wash is used as take-up liquor after treatment—is used as process water during operation and for room heating.

EXAMPLE 2

It is proceeded in a manner analogous to Example 1, yet the aqueous take-up liquor in the mixing vessel 8 is adjusted to a pH of between 1.5 and 2.5 by acid addition and is heated to 95° C. by means of hot steam. In the hydrolyzing vessel, no addition of enzyme takes place. The pH in the saccharification tank is adjusted by the addition of lye.

EXAMPLE 3

Continuous operation of the method according to the invention.

Ground corn from the storage container 2, simultaneously with hot take-up liquor previously heated to 90 to 95° C. in the mixing vessel 8, adjusted to a pH of from 6 to 7 with base ($OH^{\ominus}$ions) and containing about 50 to 70 ppm of $Ca^{2\oplus}$ions, is conducted, via the dosing worm 3, into the hydrolyzing vessel 4 in a quantitative proportion of 1 part corn grist and about 2.5 to 3 parts take-up liquor. The predetermined amount of thermostable α-amylase is continuously dosed into the hydrolyzing vessel. The hydrolyzing mixture is maintained at 90° to 95° C. by the supply of fresh steam under continuous agitation and simultaneously is drawn via the outlet provided in the bottom of the vessel. The mash, which has cooled to about 60° C., is top-charged into the saccharification tank 19, simultaneously with the amount of acid required for adjusting the pH of the mixture to 4.5 to 5.0 as well as with of at least 30 min is provided for the partial saccharification of the mash. The partially saccharified mash is continuously drawn, cooled to about 30° C. and conveyed on to the fermenting station for continuous fermentation, after adjustment of the desired mash concentration with water or distiller's wash. The utilization of the water preheated in the heat exchangers as well as of decanted distiller's wash takes place in the same manner as with the discontinuous methods described in Examples 1 and 2.

EXAMPLE 4

It is operated as in Example 3, yet with the difference that the take-up liquor is adjusted to a pH of between 1.5 and 2.5 and no enzyme is added to the contents of the hydrolyzing vessel. Instead of acid, lye ($OH^{\ominus}$ions) is continuously supplied to the saccharification tank in order to adjust the pH of from 4.5 to 5.0.

According to the invention, the method may be carried out also semi-continuously, if, for instance, two hydrolyzing vessels are provided instead of the one vessel 4 according to the drawing. While hydrolysis takes place in the first vessel, already hydrolyzed stock can be drawn from the second vessel.

In the following Table, the results of comparative tests, based on 1 t of starch present in comminuted corn grains (grain size below 0.8 mm) are summarized. There are indicated the alcohol amounts obtained from 1 t of starch in the individual tests as well as the respective amounts of NaOH, conc. $H_2SO_4$, α-amylase and amyloglucosidase (AMG) required. Furthermore, there is indicated the dextrose equivalent or degree of saccharification DE, i.e. the amount of fermentable monosaccharides present in the saccharified mash, based on the amount of anhydroglucose units theoretically present in the starch used. The α-amylase was used as an aqueous solution with 210,000 MWU/ml (modified Wohlgemut units), the AMG was used as an aqueous solution with 150 GAU/ml (glucosidase activity units).

TABLE

| | NaOH [kg] | Conc. $H_2SO_4$ [kg] | α-amylase [l] | AMG [l] | DE | Alcohol yield [l/t starch] |
|---|---|---|---|---|---|---|
| $D_{O1}$ | 0.7 | 6 | 0.58 | 3.2 | 54 | 623 |
| $D_{O2}$ | 0.7 | 6 | 0.58 | 3.2 | 56 | 630 |
| $D_{W1}$ | 0.7 | 6 | 0.58 | 3.2 | 59 | 634 |
| $D_{W2}$ | 0.7 | 6 | 0.58 | 3.2 | 61 | 634 |
| $D_{G1}$ | 0.7 | 6 | 0.58 | 3.2 | 57 | 630 |
| $D_{G2}$ | 0.7 | 6 | 0.58 | 3.2 | 58 | 630 |
| $K_{O1}$ | 0.7 | 6 | 0.58 | 3.2 | 58 | 612 |
| $K_{O2}$ | 0.7 | 6 | 0.58 | 3.2 | 56 | 612 |
| $K_{O3}$ | 0.7 | 6 | 0.58 | 3.2 | 60 | 619 |
| $K_{O4}$ | 0.7 | 6 | 0.58 | 3.2 | 60 | 619 |
| $K_{O5}$ | 0.7 | 6 | 0.58 | 3.2 | 57 | 619 |
| $K_{O6}$ | 0.7 | 6 | 0.58 | 3.2 | 60 | 619 |
| $K_{A1}$ | 0.7 | 6 | 0.58 | 3.2 | 50 | 594 |
| $K_{A2}$ | 0.7 | 6 | 0.58 | 48 | 48 | 594 |
| $K_{A3}$ | 0.7 | 6 | 0.275 | 1.6 | 29 | 493 |
| $H_{O1}$ | 0.7 | 6 | 0.58 | 3.2 | 60 | 637 |
| $H_{O2}$ | 0.7 | 6 | 0.58 | 3.2 | 58 | 637 |
| $H_{O3}$ | 0.7 | 6 | 0.58 | 3.2 | 61 | 637 |
| $H_{O4}$ | 0.7 | 6 | 0.58 | 3.2 | 59 | 645 |
| $H_{O5}$ | 0.7 | 6 | 0.58 | 3.2 | 60 | 645 |
| $H_{O6}$ | 0.7 | 6 | 0.58 | 3.2 | 54 | 645 |
| $H_{O7}$ | 0.7 | 6 | 0.58 | 3.2 | 54 | 645 |
| $H_{O8}$ | 0.7 | 6 | 0.58 | 3.2 | 59 | 645 |
| $H_{O9}$ | 0.7 | 6 | 0.58 | 3.2 | 42 | 645 |
| $H_{O10}$ | 0.7 | 6 | 0.58 | 3.2 | 39 | 645 |
| $H_{O11}$ | 0.7 | 6 | 0.58 | 3.2 | 41 | 645 |
| $H_{O12}$ | 0.7 | 6 | 0.275 | 1.6 | 35 | 637 |
| $H_{O13}$ | 0.7 | 6 | 0.275 | 1.6 | 34 | 645 |
| $H_{O14}$ | 0.7 | 6 | 0.275 | 1.6 | 39 | 637 |
| $H_{O15}$ | 0.7 | 6 | 0.275 | 1.6 | 38 | 645 |
| $H_{O16}$ | 0.7 | 6 | 0.138 | 1.6 | 35 | 637 |
| $H_{O17}$ | 0.7 | 6 | 0.0275 | 1.6 | 33 | 616 |
| $H_{A1}$ | 36.7 | 50 | — | 3.2 | 67 | 652 |
| $H_{A2}$ | 15.2 | 21.5 | — | 3.2 | 63 | 637 |
| $H_{A3}$ | 7.2 | 15 | — | 3.2 | 63 | 623 |
| $H_O$ | 0.7 | 6 | 0.58 | 3.2 | 60 | 645 |
| $H_{S1}$ | 7.3 | 7.4 | 0.58 | 3.2 | 64 | 645 |
| $H_{S2}$ | 14 | 15.6 | 0.58 | 3.2 | 66 | 645 |
| $H_{S3}$ | 17.5 | 19.7 | 0.58 | 3.2 | 67 | 637 |
| $H_{S4}$ | 22.7 | 24.8 | 0.58 | 3.2 | 65 | 645 |
| $H_{S5}$ | 26 | 31.6 | 0.58 | 3.2 | 60 | 645 |
| $H_{S6}$ | 27.7 | 33.3 | 0.58 | 3.2 | 59 | 645 |

In the far left column of the Table, the type of the hydrolyzing method applied is indicated. meaning:
$D_O$: Continuous pressure method
$D_W$: Continuous pressure method with heat recovery
$D_G$: Discontinuous pressure hydrolysis
$K_O$: Boiling method
$K_A$: Cold mashing method
$H_O$: Method according to invention with solubilizing enzyme as hydrolyzing agent
$H_A$: Method according to invention with acid as hydrolyzing agent
$H_S$: Method according to invention with solubilizing enzyme as hydrolyzing agent and recycling of distiller's wash.

When applying the continuous high-pressure steam method ($D_O$), in addition to a high demand of energy, difficulties will arise also because of the gelatinization of the starch, in particular with the tests including heat recovery ($D_W$), which caused obstructions of the plant several times.

When applying the boiling method without pressure ($K_O$), according to which the hydrolyzing mixture is heated from 60° C. (i.e. below the gelatinization temperature) to about 90° C., a low degree of saccharification is reached, thus resulting in a lower alcohol yield. As expected, even worse results were achieved with the cold mashing method ($K_A$) initially mentioned as prior art.

The tests $H_{O\,12}$ and $H_{O\,17}$ —as is apparent from the Table—were carried out with a slighter amount of α-amylase. It has proved that a reduced introduction of enzyme of between 0.138 and 0.58 l of α-amylase solution per t of starch do not lead to a substantial reduction in the alcohol yield. However, when using only 0.0275 l of enzyme solution, hydrolysis apparently is not sufficiently complete.

In the tests $H_{S\,1}$ to $H_{S\,6}$, decanted destiller's wash was used as take-up liquor. The distiller's wash each came from the preceding test, it was treated and re-used in the following test. This procedure was repeated six times, i.e. the distiller's wash from test 1 was used as take-up liquor for test 2, the distiller's wash resulting from test 2 was used for test 3, etc. As indicated by the obtained results, no negative influence on the fermentation operation can be observed. The content of dry substance of the distiller's wash in the tests varied between 1 and 12.5%.

The energy consumption for the hydrolyzing method according to the invention, including the fermentation for the production of 1 hl of alcohol from corn was calculated as follows:

To produce 1 hl of alcohol, about 250 to 260 kg of ground corn having a starch content of about 60 to 63% are required. In order to heat this amount of ground corn from 20° C. to 95° C. (Δt=75° C.), 33 to 34 MJ of thermal energy are required, which corresponds to a steam amount of 15 to 15.5 kg.

(A) If water is used as take-up liquor, 0.6 to 0.75 $m^3$ are required for the corn amount indicated. On the assumption that the water is pre-heated from an initial temperature of 15° C. to 45° C. in the first heat exchanger and to 80° C. in the second heat exchanger, 38 to 47 MJ must be supplied to this amount of water in order to raise it to a temperature of 95° C. (Δt=15° C.). This amount of heat is made available by supplying further 17 to 21 kg of steam. In total, 73 to 82 MJ to 36.5 kg of steam) are, thus, required to produce 1 hl of alcohol.

(B) If 0.6 to 0.75 $m^3$ decanted distiller's wash having a temperature of from 80° to 90° C. are used as take-up liquor, an energy demand of only 25 to 31 MJ (corresponding to 11 to 14 kg of steam) results for heating to an average temperature of from 85° C. to 95° C. (Δt=10° C.) In this case, it has not been taken into account that the amount of energy necessary to heat the distiller's wash, because of the content of dry substance in the distiller's wash, is even less than would be required to heat an equal amount of water. Thus, only 59 to 66 MJ, i.e. 26 to 29.5 kg of steam, are required in total per hl of alcohol.

A comparison of these values with the corresponding data initially indicated for the known pressure methods, illustrates the great superiority of the method according to the invention even in terms of energy balance.

What is claimed is:

1. A method for hydrolyzing amylaceous grains to produce saccharified mash; comprising the steps of:

providing an aqueous take-up liquor at a temperature between 85° and 100°;

directly and continuously adding, under agitation, raw untreated amylaceous grains to the liquor for gelatinizing the grains at atmospheric pressure and at said temperature range between 85° and 100°;

introducing a solubilizing enzyme to the liquor after commencing said adding step of raw untreated amylaceous grains to provide a hydrolyzed mixture, with said adding step being continued during and after introduction of the solubilizing enzyme; and withdrawing and cooling the hydrolyzed mixture to a temperature from at least 60° to 65° before being fed for saccharification.

2. A method as set forth in claim 1, wherein said take-up liquor at least partially comprises distiller's wash derived from distillative processing of saccharified mash subjected to alcoholic fermentation, said distiller's wash being used without cooling.

3. A method as set forth in claim 2, wherein said distiller's wash is used after separation of solids.

4. A method as set forth in claim 1 wherein said introducing step includes adding the solubilizing enzyme after about 20–30% of a total amount of raw untreated amylaceous grains are added to the liquor.

5. A method as set forth in claim 1 wherein the solubilizing enzyme has a pH value adjusted to a range of 6.0 to 7.0.

6. A method as set forth in claim 1 wherein said adding step includes a weight ratio between the raw untreated amylaceous grains and the take-up liquor of 1: 2.3–3.3.

7. A method as set forth in claim 1, and further comprising adding amyloglucosidase at a pH value from 4.5 to 5.0 to saccharify the hydrolyzed mixture to a dextrose equivalent of at least about 50 at a temperature between 60° to 65° C.

* * * * *